United States Patent [19]

Heath

[11] Patent Number: 5,060,501

[45] Date of Patent: Oct. 29, 1991

[54] FLAT METAL STOCK BENDING DIE

[75] Inventor: Roger K. Heath, Uxbridge, Mass.

[73] Assignee: Century Manufacturing Co. Inc., Holliston, Mass.

[21] Appl. No.: 645,721

[22] Filed: Jan. 25, 1991

[51] Int. Cl.[5] ..... B21D 5/01

[52] U.S. Cl. ..... 72/382; 72/389; 72/396; 72/413; 72/473

[58] Field of Search ..... 72/381, 382, 389, 412, 72/413, 473, 396, 481

[56] References Cited

U.S. PATENT DOCUMENTS

| | | | |
|---|---|---|---|
| 2,882,952 | 4/1959 | Johnson | 72/396 |
| 2,916,073 | 12/1959 | Johnson | 72/396 |

FOREIGN PATENT DOCUMENTS

| | | | |
|---|---|---|---|
| 0013554 | 6/1968 | Japan | 72/389 |
| 0024745 | 10/1969 | Japan | 72/382 |
| 0158527 | 7/1987 | Japan | 72/389 |
| 0138669 | 1/1953 | Sweden | 72/389 |
| 1386332 | 4/1988 | U.S.S.R. | 72/389 |

*Primary Examiner*—David Jones

*Attorney, Agent, or Firm*—John E. Toupal; Harold G. Jarcho

[57] ABSTRACT

A die for use with a punch for bending flat metal stock and including a body defining a support surface adapted to support a piece of flat metal stock, a cavity disposed in a path of movement of the punch and intersecting and projecting below the support surface, and a stop surface forming a bottom wall of the cavity and having first and second surface portions; and a mounting retained by the body. A first elongated die bar is supported by the mouting for both translational and pivotal movement on a first axis in the cavity on one side of the path of movement; the first die bar defining upper and lower surfaces having a wedge shaped cross-section. A second elongated die bar also is supported by the mounting for both translational and pivotal movement on a second axis in the cavity on an opposite side of the path of movement; the second die bar defining upper and lower surfaces having a wedge shaped cross-section. This combination eliminates scoring during the bending of flat metal stock.

17 Claims, 1 Drawing Sheet

FLAT METAL STOCK BENDING DIE

BACKGROUND OF THE INVENTION

This application relates generally to a die and, more particularly, to a die for bending flat metal stock.

Fixed V-shaped female dies and punches are used commonly to bend flat metal stock and particularly sheet metal into precise angles. A primary disadvantage of V-shaped female dies and punches is their inherent tendency to produce distinctly perceptible scores on the metal stock adjacent to the bend along the line at which the edges of the female die engage the sheet metal stock when the punch is rammed into the stock to move it into the die. Such scores are highly objectionable to manufacturers having rigid quality specifications.

An improved flat metal stock bending die is disclosed in U.S. Pat. No. 2,882,952. That patent discloses a die employing a pair of parallel elongated die bars having a semi-circular cross sectional configuration and mounted for pivotal movement along their longitudinal axes. Although offering some improvement over V-shaped die and punch assemblies, the die disclosed in U.S. Pat. No. 2,882,952 fails to completely eliminate the problem of material scoring because of a certain degree of relative movement that occurs between the die bars and the flat metal stock during a bending operation.

The object of this invention, therefore, is to provide an improved die for use with a punch for bending flat metal stock.

SUMMARY OF THE INVENTION

The invention is a die for use with a punch for bending flat metal stock and including a body defining a support surface adapted to support a piece of flat metal stock, a cavity disposed in a path of movement of the punch and intersecting and projecting below the support surface, and a stop surface forming a bottom wall of the cavity and having first and second surface portions; and a mounting means retained by the body. A first elongated die bar is supported by the mounting means for both translational and pivotal movement on a first axis in the cavity on one side of the path of movement; the first die bar defining upper and lower surfaces having a wedge shaped cross-section including upper and lower legs defined by, respectively, the upper and lower surfaces; the lower surface conforming to the first surface portion and adapted for engagement therewith; and the first axis extending longitudinally of the first die bar and disposed between both said upper and lower surfaces and the support surface and the first surface portion. A second elongated die bar also is supported by the mounting means for both translational and pivotal movement on a second axis in the cavity on an opposite side of the path of movement; the second die bar defining upper and lower surfaces having a wedge shaped cross-section including upper and lower legs defined by, respectively, the upper and lower surfaces of the second die bar; the lower surface of the second die bar conforming to the second surface portion and adapted for engagement therewith; and wherein the second axis extends longitudinally of the second die bar and is disposed between both the upper and lower surfaces of said second die bar and the support surface and the second surface portion. This combination eliminates scoring during the bending of flat metal stock.

According to certain features of the invention, the wedge shaped cross-sections of the first and second die bars are sectors having respectively, a first apex and a second apex, upper and lower surfaces of both the first and second die bars and the first and second surface portions are all planar, and the first and second axes are disposed substantially equally spaced between the support surface and, respectively, the first and second surface portions. These features facilitate the angular bending of flat metal stock.

According to yet another feature of the invention, the mounting means is adapted to maintain the first apex and the second apex substantially in engagement during movement of the first and second die bars. Maintaining engagement of the first and second apexes provides continuous support of that portion of the stock being bent during the bending operation.

According to a further feature of the invention, the upper and lower legs of the cross-sections of both the first and second die bars have a length greater than the spacing between, respectively, the first apex and the first axis and the second apex and the second axis. This feature insures full support of the flat stock during the bending operation.

According to still another feature of the invention, the cavity comprises a groove of rectangular cross-section in the body. A rectangular groove is particularly well suited for producing angular bends.

According to other features of the invention, the groove has a width W, the legs in each of the sectors are connected by a curve having a radius equal to $$\frac{W}{2},$$

in each sector a radial line between its apex and its curve is equal to $$\frac{W}{2},$$

and each sector forms an angle substantially equal to 45°. These features facilitate the creation of 90° bends. In one preferred form of the invention, the sectors form an angle slightly greater than 45°. A sector angle slightly greater than 90° compensates for springback of the metal stock after the bending operation.

According to still another feature of the invention includes a bias mechanism biasing the first and second die bars into positions with one leg of each sector aligned with the support surface and the other leg of each sector disposed in the cavity. This feature insures return of the die bars to an initial position after a bending operation.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
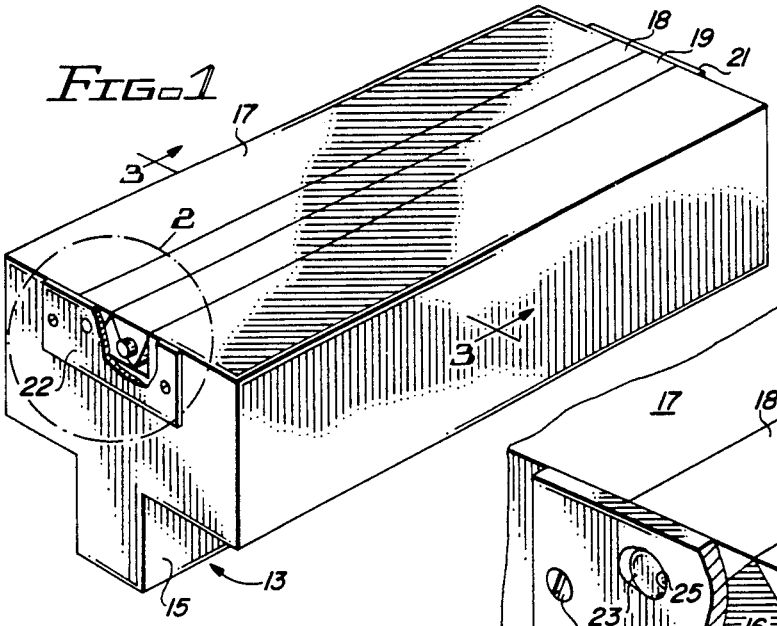
FIG. 1 is a perspective view of a bending die according to the invention.
Figure 2:
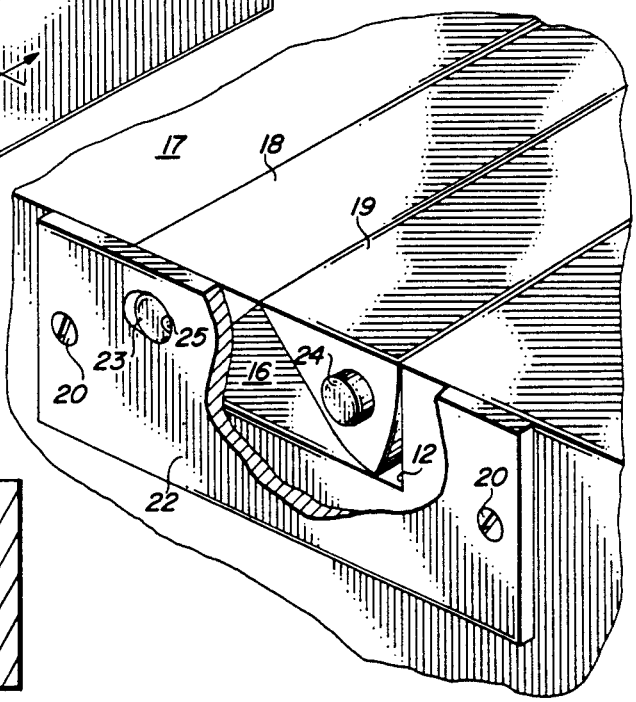
FIG. 2 is a detailed view of a support assembly for die bars shown in the bending die of FIG. 1.

Illustrated in FIG. 1 is a die assembly 11 constructed in accordance with the invention. The die assembly 11 includes an elongated body member 13 adapted for mounting on a work plateau (not shown). Formed on the bottom of the body 13 is a rib 15 for coupling engagement on a bolster (not shown) of a power brake. An elongated groove 12 of rectangular cross section forms a cavity 16 in an upper surface of the body member 13. An upper surface of the body member 13 forms a planar horizontally oriented support surface 17 that is intersected by the cavity 16.

Figure 4:
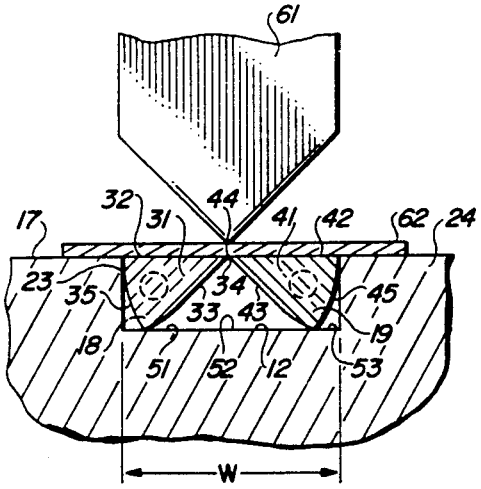
FIG. 4 is a cross-sectional view of the bending die shown in FIG. 1 and including a piece of flat metal stock and a V-shaped punch.
Figure 5:
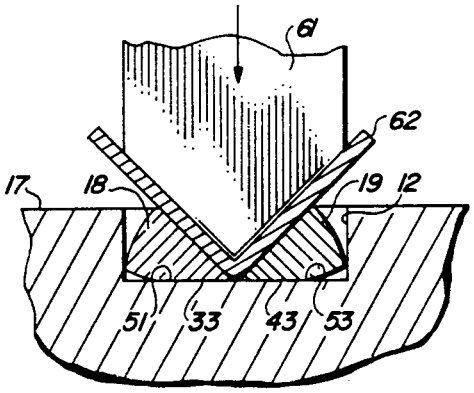
FIG. 5 is another cross-sectional view similar to that shown in FIG. 4, but after completion of a bending stroke by the punch.

Also included in the die assembly 11 are first and second elongated die bars 18, 19, respectively, retained in a parallel relationship within the cavity 16. The die bars 18, 19 are supported from the body member 13 by end plates 21, 22 secured thereto by screws 20. Extending from each opposite end of each die bar 18, 19, respectively, is a pivot pin 23, 24. Retaining the pins 23, 24 and supporting the die bars 18, 19 are a pair of slots 25 in each of the end plates 21, 22. The slots 25 allow pivotal movement of the die bar 21, 22, respectively, along first and second longitudinal axes as shown in FIGS. 4 and 5. In addition, the slots 25 allow limited translational movement of the die bars 18, 19 during their pivotal movement.

As illustrated in FIGS. 4 and 5, the first die bar 18 has a wedge shaped cross section 31 preferably in the form of a sector of a circle. An upper planar surface 32 of the first die bar 18 defines an upper leg of the section 31 while a lower planar surface 33 of the die bar 18 defines a lower leg of the sector 31. First ends of the sector legs are joined at a first apex 34 while opposite ends thereof are joined by a circular curve defined by a circular surface 35 of the die bar 18.

Figure 3:
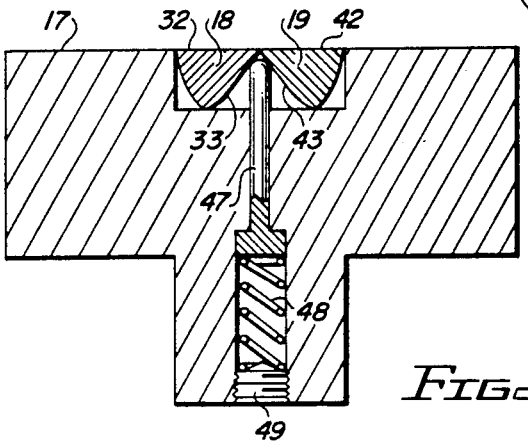
FIG. 3 is a cross-sectional view taken along lines 3—3 in FIG. 1.

The second die bar 19 is identical to the first die bar 18, also having a cross section in the form of a section 41. An upper leg of the sector 41 is defined by a planar upper surface 42 of the die bar 19 while a lower leg thereof is defined by a lower planar surface 43 of the die bar 19. First ends of the sector legs are joined at a second apex 44 while opposite ends are joined by a circular curve defined by a circular surface 45 joining the upper and lower surfaces 42, 43 of the die bar 19. Engaging the lower surfaces 33 and 43 of, respectively, the first and second die bars 18 and 19 is one end of a pair of pins 47 (FIG. 3). A bias spring member 48 is positioned between an opposite end of each pin 47 and a portion of the body member 13 defined by a retaining screw 49. The springs 48 and pins 47 bias the first and second die bars 18 and 19 into positions with the upper surfaces 32 and 42 thereof aligned with the support surface 17 of the body member 13.

As shown in FIGS. 4 and 5, the first pivotal axis 23 of the first die bar 18 is equally spaced between the support surface 17 and a first planar surface portion 51 of a stop surface 52 formed by the bottom of the cavity groove 16 in the body member 15. Similarly, the pivotal axis 24 of the second die bar 19 is positioned equally spaced between the support surface 17 and a second planar surface portion 53 of the stop surface 52. Also, both the radii of the circular surfaces 35 and 45 and the radial spacing between, respectively, between the first apex 34 and the curved surface 35 and the second apex 44 and the curved surface 45 are equal to one-half the width W of the groove cavity 16 in the body member 13.

During a bending operation, a V-shaped punch 61 is brought into engagement with a piece of metal stock 62 along a line at which a bend is to be created and aligned with the substantially engaged first and second apices 34, 44 of the first and second die bars 18 and 19. Further downward movement of the punch 61 bends the piece 62 at a desired angle as shown in FIG. 5. To create 90° bends the sectors 31 and 42 define angles of substantially 45° and preferably about 46° so as to allow for spring back of the metal stock piece 62 after the bending operation.

As the piece 62 is bent, its lower surface is supported by the planar upper surfaces 32 and 42 of the die bars 18 and 19 and no relative movement occurs therebetween. Therefore, scoring of the piece 62 is prevented during the bending process. In addition, the curved surfaces 35 and 45 maintain tangential contact with the sidewalls of the groove 12 during the entire bending operation. At the completion of the downstroke of the punch 61, the bottom planar surfaces 33 and 43 engage, respectively, the conforming planar first and second surface portions 51 and 53 of the groove bottom stop surface 52 so as to establish an unyielding support for the stock piece 62.

Obviously, many modifications and variations of the present invention are possible in light of the above teachings. For example, the die assembly 11 can be modified to bend stock into configurations other than the 90° bends illustrated. It is to be understood, therefore, that the invention can be practiced otherwise than as specifically described.

What is claimed:

1. A die for use with a punch for bending flat metal stock and comprising:

body means defining a support surface adapted to support a piece of flat metal stock, a cavity disposed in a path of movement of the punch and intersecting and projecting below said support surface, and a stop surface forming a bottom wall of said cavity and having first and second surface portions;

mounting means retained by said body means;

a first elongated die bar supported by said mounting means for both translational and pivotal movement on a first axis in said cavity on one side of said path of movement; said first die bar defining upper and lower surfaces having a wedge shaped cross-section including upper and lower legs defined by, respectively, said upper and lower surfaces; said lower surface of said first die bar conforming to said first surface portion and adapted for engagement therewith; and wherein said first axis extends longitudinally of said first die bar and is disposed between both said upper and lower surfaces and said support surface and said first surface portion; and a second elongated die bar supported by said mounting means for both translational and pivotal movement on a second axis in said cavity on an opposite side of said path of movement; said second die bar defining upper and lower surfaces of complementary shape and having a wedge shaped cross-section including upper and lower legs defined by, respectively, said upper and lower surfaces of said second die bar; said lower surface of said second die bar conforming to said second surface portion and adapted for engagement therewith; and wherein said second axis extends longitudinally of said second die bar and is disposed between both said upper and lower surfaces of said second die bar and said support surface and said second surface portion.

2. A die according to claim 1 wherein said wedge shaped cross-sections of said first and second die bars are sectors having, respectively, a first apex and a second apex, said upper and lower surfaces of both said first and second die bars and said first and second surface portions are all planar, and said first and second axes are disposed substantially equally spaced between said support surface and, respectively, said first and second surface portions.

3. A die according to claim 2 wherein said mounting means is adapted to maintain said first apex and said second apex substantially in engagement during said movement of said first and second die bars.

4. A die according to claim 3 wherein said upper and lower legs of said cross-sections of both said first and second die bars have a length greater than the spacing between, respectively, said first apex and said first axis and said second apex and said second axis.

5. A die according to claim 4 wherein said cavity comprises a groove of rectangular cross-section in said body means.

6. A die according to claim 5 wherein said groove has a width W and said legs in each of said sectors are connected by a curve having a radius equal to $$\frac{W}{2}.$$

7. A die according to claim 6 wherein in each of said sectors a radial line between said apex and said curve is equal to $$\frac{W}{2}.$$

8. A die according to claim 7 wherein each of said sectors forms an angle substantially equal to 45°.

9. A die according to claim 7 wherein each of said sectors forms an angle slightly greater than 45°.

10. A die according to claim 2 including bias means biasing said first and second die bars into positions with one leg of each said sector aligned with said support surface and the other leg of each said sector disposed in said cavity.

11. A die according to claim 10 wherein said mounting means is adapted to maintain said first apex and said second apex substantially in engagement during said movement of said first and second die bars.

12. A die according to claim 11 wherein said upper and lower legs of said cross-sections of both said first and second die bars have a length greater than the spacing between, respectively, said first apex and said first axis and said second apex and said second axis.

13. A die according to claim 12 wherein said cavity comprises a groove of rectangular cross-section in said body means.

14. A die according to claim 13 wherein said groove has a width W and said legs in each of said sectors are connected by a curve having a radius equal to $$\frac{W}{2}.$$

15. A die according to claim 14 wherein in each of said sectors a radial line between said apex and said curve is equal to $$\frac{W}{2}.$$

16. A die according to claim 15 wherein each of said sectors forms an angle substantially equal to 45°.

17. A die according to claim 15 wherein each of said sectors forms an angle slightly greater than 45°.

* * * * *